US009961990B2

(12) United States Patent
Benden

(10) Patent No.: US 9,961,990 B2
(45) Date of Patent: May 8, 2018

(54) ADJUSTABLE FOOTREST FOR ADJUSTABLE-HEIGHT DESK

(71) Applicant: The Texas A&M University System, College Station, TX (US)

(72) Inventor: Mark E. Benden, College Station, TX (US)

(73) Assignee: The Texas A&M University System, College Station, TX (US)

( * ) Notice: Subject to any disclaimer, the term of this patent is extended or adjusted under 35 U.S.C. 154(b) by 0 days. days.

(21) Appl. No.: 13/946,004

(22) Filed: Jul. 19, 2013

(65) Prior Publication Data

US 2014/0020606 A1 Jan. 23, 2014

Related U.S. Application Data

(60) Provisional application No. 61/674,271, filed on Jul. 20, 2012.

(51) Int. Cl.
*A47B 9/00* (2006.01)
*A47B 13/00* (2006.01)
(Continued)

(52) U.S. Cl.
CPC ..... *A47B 13/00* (2013.01); *A47B 9/00* (2013.01); *A47B 21/02* (2013.01); *A47B 97/00* (2013.01);
(Continued)

(58) Field of Classification Search
CPC ..... A47B 13/00; A47B 97/00; A47B 9/00
(Continued)

(56) References Cited

U.S. PATENT DOCUMENTS 4,593,874 A 6/1986 Dunagan
4,714,025 A 12/1987 Wallin et al.
(Continued)

OTHER PUBLICATIONS

"Electric Height Adjustable Desks," Obtained from http://www.thehumansolution.com/elheadde.html, Date retrieved Jul. 19, 2012, 6 pages.

(Continued)

*Primary Examiner* — Daniel J Troy
*Assistant Examiner* — Timothy M Ayres
(74) *Attorney, Agent, or Firm* — Winstead PC

(57) ABSTRACT

An adjustable desk has base members or sidewalls supporting the desk on a surface. Each sidewall has at least one support movably vertically relative to the sidewall. A tabletop is disposed above the base member and is supported on the supports. A footrest is disposed between the base members beneath the tabletop and can move between a back position toward a back of the desk and a front position toward a front of the desk. One or more mechanisms operatively couple to at least one of the supports and to the footrest. The one or more mechanisms move the at least one support vertically relative to the base member to raise and lower the tabletop relative to the sidewall. Likewise, the one or more mechanisms move the footrest between the back and front positions. Preferably, movement of the footrest is coordinated with the movement of the tabletop so that the footrest moves to the front position when the tabletop is raised for standing and moves to the back position when the tabletop is lowered for sitting.

29 Claims, 11 Drawing Sheets

(51) Int. Cl.
*A47B 97/00* (2006.01)
*A47B 21/02* (2006.01)
*A47B 17/02* (2006.01)

(52) U.S. Cl.
CPC ..... *A47B 17/02* (2013.01); *A47B 2200/0053* (2013.01); *A47B 2200/0097* (2013.01)

(58) Field of Classification Search
USPC ..... 108/50.14, 144.11, 147; 312/319.9
See application file for complete search history.

(56) References Cited

U.S. PATENT DOCUMENTS

| | | | | |
|---|---|---|---|---|
| 5,041,770 | A * | 8/1991 | Seiler et al. | 318/265 |
| 5,098,160 | A * | 3/1992 | Moore et al. | 297/423.4 |
| 5,271,320 | A | 12/1993 | Reneau | |
| 5,289,782 | A * | 3/1994 | Rizzi et al. | 108/147 |
| 5,323,695 | A | 6/1994 | Borgman et al. | |
| 5,483,903 | A | 1/1996 | Pierce et al. | |
| 5,495,811 | A | 3/1996 | Carson et al. | |
| 5,826,941 | A * | 10/1998 | Olsen | 297/423.39 |
| 6,062,148 | A | 5/2000 | Hodge et al. | |
| 6,286,441 | B1 | 9/2001 | Burdi et al. | |
| 7,322,656 | B2 * | 1/2008 | Wang | 297/423.41 |
| D649,368 | S | 11/2011 | Benden | |
| D649,369 | S | 11/2011 | Benden | |
| 9,700,135 | B2 * | 7/2017 | Herring | A47B 9/00 |
| 2005/0247239 | A1 | 11/2005 | Newhouse et al. | |
| 2007/0034754 | A1 | 2/2007 | McKeon | |
| 2009/0178596 | A1 * | 7/2009 | Skiba | 108/102 |
| 2012/0088633 | A1 | 4/2012 | Crafton | |

OTHER PUBLICATIONS

"Adjustable Desks: Electric Adjustable Height Desk, Stand Up Desk, Sit to Stand Desks," Obtained from http://www.ergodepot.com/Adjustable_Desks_s/134.htm, Date retrieved Jul. 19, 2013, 2 pages.

"NewHeights Manual Crank Sit to Stand Desk w/ Hand Crank Height Adjustment Control (RA-24XXNCW)," Obtained from http://www.beyondtheofficedoor.com/RA-24XXNCW.php, Date retrieved Jul. 19, 2013, 7 pages.

"The VertDesk Electric Adjustable Height Desk with Push Button Height Adjustment (BTOD-VERTDESK)," Obtained from http://www.beyondtheofficedoor.com/vertdesk.php, Date retrieved Jul. 19, 2012, 2 pages.

* cited by examiner

ADJUSTABLE FOOTREST FOR ADJUSTABLE-HEIGHT DESK

CROSS-REFERENCE TO RELATED APPLICATIONS

This application claims the benefit of U.S. Provisional Appl. 61/674,271, filed 20 Jul. 2012, which is incorporated herein by reference in its entirety.

BACKGROUND OF THE DISCLOSURE

Recent research shows that standing for part of one's day to offset seated time improves the health of adult workers. In fact, recent epidemiological studies show that decreasing total sedentary time can have significant positive health implications for current and future office workers.

Desk can be adjusted in height from sitting to standing for the purpose of reducing standing fatigue and thereby increasing total standing time. Historically, floor-mounted footrests are used on the floor under the desk. Unfortunately, space under the desk can be limited, and the floor-mounted footrests need to be moved when a user is seated. Moreover, the floor-mounted footrest is also a challenge for cleaning crews, and the floor-mounted footrest complicates the management of phone lines and computer cables under the desk. For these reasons, a floor-mounted footrest can be undesirable.

The subject matter of the present disclosure is directed to overcoming, or at least reducing the effects of, one or more of the problems set forth above.

SUMMARY OF THE DISCLOSURE

An adjustable desk has base members or sidewalls supporting the desk on a surface. Each sidewall has at least one support movably vertically relative to the sidewall. A tabletop is disposed above the base member and is supported on the supports. A footrest is disposed between the base members beneath the tabletop and can move between a back position toward a back of the desk and a front position toward a front of the desk. One or more mechanisms operatively couple to at least one of the supports and to the footrest. The one or more mechanisms move the at least one support vertically relative to the base member to raise and lower the tabletop relative to the sidewall. Likewise, the one or more mechanisms move the footrest between the back and front positions. Preferably, movement of the footrest is coordinated with the movement of the tabletop so that the footrest moves to the front position when the tabletop is raised for standing and moves to the back position when the tabletop is lowered for sitting.

In one particular embodiment, a desk has a tabletop and has at least one base member supporting the tabletop. A footrest is disposed on the at least one base member beneath the tabletop. The footrest is movable between a back position toward a back of the desk and a front position toward a front of the desk. One or more mechanisms disposed on the at least one base member is operatively coupled to the footrest, the one or more mechanisms moving the footrest between the back and front positions.

In another embodiment, a desk has at least one base member with a support movable vertically relative to the at least one base member. A tabletop is supported on the support above the at least one base member, and a footrest is disposed on the at least one base member beneath the tabletop. The footrest is movable between a back position toward a back of the desk and a front position toward a front of the desk.

One or more mechanisms disposed on the at least one base member are operatively coupled to the support and to the footrest. The one or more mechanisms can move the support vertically relative to the at least one base member to raise and lower the tabletop relative to the at least one base member. Additionally, the one or more mechanisms can move the footrest between the back and front positions. In fact, the one or more mechanisms can coordinate the movement of the at least one support between lowered and raised positions to the movement of the footrest between the back and front positions.

In another embodiment, an adjustable footrest can be used below a work surface. The footrest has at least one base member disposed below the work surface and has a rest disposed on the at least one base member. The rest is movable between a back position toward a back of the work surface and a front position toward a front of the work surface. One or more mechanisms disposed on the at least one base member are operatively coupled to the rest and can move the rest between the back and front positions.

DETAILED DESCRIPTION OF THE DISCLOSURE

Figure 1A:
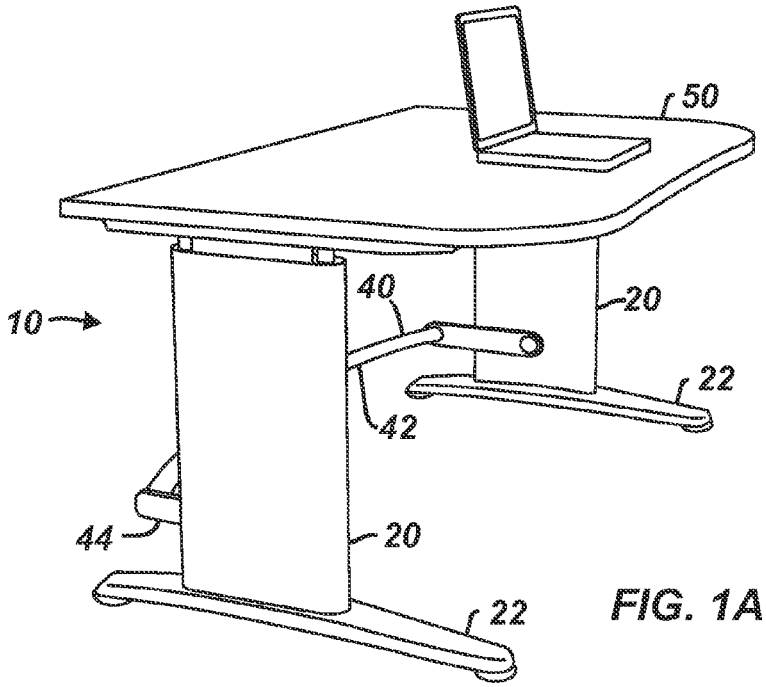
FIG. 1A illustrates a perspective view of an adjustable desk according to the present disclosure having a tabletop in a lowered condition and a rotatable footrest in a back position for a sitting user.

FIG. 1A illustrates a perspective view of an adjustable desk 10 according to the present disclosure having a tabletop 50 and a footrest 40. As provided in more detail below, the desk 10 also includes an apparatus using electric actuation, manual crank, counterbalance (spring and gas lift), and/or other mechanism to adjust the height of the desk's tabletop 50 and to switch the position of the desk's footrest 40.

Figure 1B:
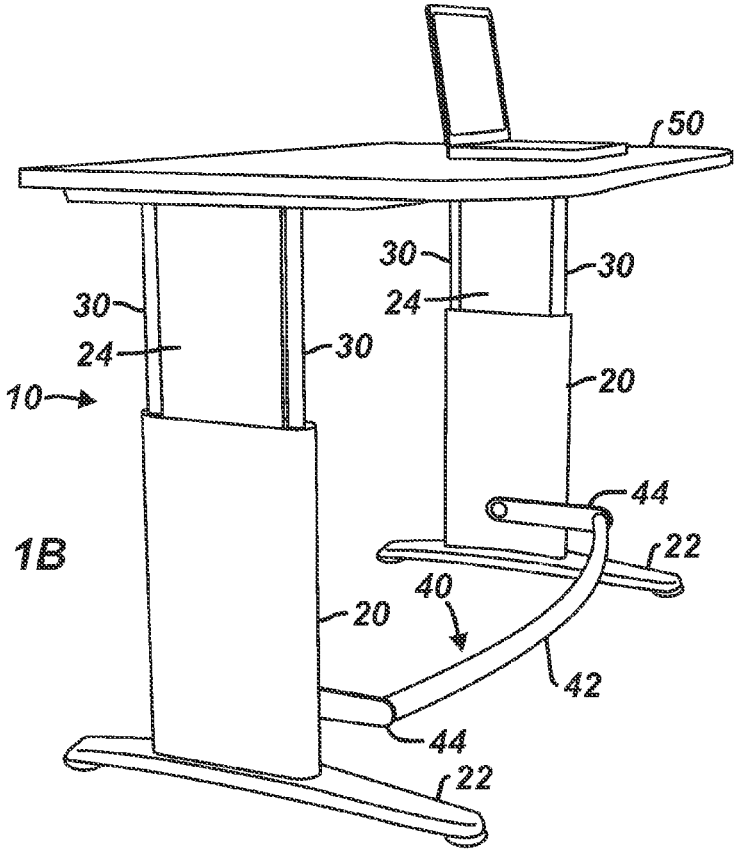
FIG. 1B illustrates a perspective view of the adjustable desk having the tabletop in a raised condition and the rotatable footrest in a front position for a standing user.

For example, FIG. 1A shows the tabletop 50 in a lowered condition and shows the footrest 40 in a back position for a user who is sitting. By contrast, FIG. 1B shows the tabletop 50 in a raised condition and shows the footrest 40 in a front position for a user who is standing.

As can be seen, the desk 10 incorporates the adjustable tabletop 50 with an adjustable footrest 40. The tabletop 50 is made to be anthropometrically correct and offers a work surface with adjustable height for the user. For an adult, the tabletop 50 can be raised to a height of about 36-46" for standing and can be lowered to a height of about 26-33" for sitting. Other ranges of adjustment can be provided and can be tailored to children as well.

The footrest 50 is user-adjustable to set a proper range for foot support during standing and sitting. In this way, the footrest 40 provides a useful ergonomic feature for the desk 10 when the tabletop 50 is raised to a standing height or lowered to a sitting height. Overall, the footrest 40 can increase the user's total standing time, which has health benefits and which adds to the overall comfort of the user.

Because the height of the tabletop 50 can be adjusted as desired by the user, the footrest 40 is preferably at or near its back position when the tabletop 50 is in the sitting height. By contrast, the footrest 40 is preferably at or near its front position when the tabletop 50 is at the lower range of the standing heights. In this way, a standing user who has the tabletop 50 set at a lower standing height can still use the footrest 40. As expected, moving the footrest 40 in or out of the way may require movement of the footrest 40 that is timed, delayed, or accelerated in comparison to the tabletop's movement depending on the mechanism used.

Automated and manual mechanisms can be used to move the tabletop 50 and footrest 40, but preferably movement of the tabletop 50 and footrest 40 to their different positions uses an automated mechanism. In addition, the footrest 40 preferably transitions automatically between standing and sitting positions as the tabletop 50 is raised and lowered, but this is not strictly necessary.

The adjustable table 10 has sidewalls or base members 20 with feet 22 that rest on the floor and support the tabletop 50 using supports or columns 30. In general, the column or support 30 can be a panel, beam, planar support, or other structure and need not be a cylindrical post as illustrated. Although each sidewall 20 has two columns 30 as shown, it will be appreciated that only one column or support 30 may be used in a given implementation. For stability, however, a wide support or more than one cylindrical post are preferably used on both sides of the tabletop 50 so that the tabletop 50 will not exhibit a tendency to warp, which can inhibit the up and down movement of the tabletop 50.

As shown, each sidewall 20 has two columns 30, and a central area between the columns 30 preferably has a panel 24. In the lowered condition, the columns 30 and panels 24 retract into the sidewalls 20 as the tabletop 50 is brought close to the top edge of the sidewalls 20. In the raised condition, the columns 30 extend from the sidewalls 20 as the tabletop 50 is raised. The side panels 24 disposed between the columns 30 also extend from the sidewalls 20 to complete the side coverage of the desk 10. In this arrangement, the panels 24 can provide further stability, but they can also prevent objects from inserting between the tabletop 50 and sidewalls 20, which could hinder operation or cause injury. Overall, the sidewalls 20 provide a robust physical structure so the support columns 30 in each support 20 are essentially tied together to provide stability even when the tabletop 50 is raised to the greatest standing height.

Relative to the user, the footrest 40 deploys from a back position (toward the back edge of the desk 10) while the user is seated to a front position (toward the front edge of the desk 10) while the user is standing. Movement of the footrest 40 can be coordinated with the lift mechanism for moving the tabletop 50 as detailed below. In this way, the footrest 40 can move out of the way in the back position (FIG. 1A) while the tabletop 50 is in a seated height and the user is seated in a normal chair at the desk, although the footrest 40 may allow the user to extend his or her legs outward to the footrest 40 for foot support while sitting. Then, the footrest 40 can be moved automatically to a front position (FIG. 1B) appropriate for intermittent foot support while the user is standing at the raised tabletop 50. In general, the footrest 40 allows the user to put one foot on the rest while standing on the other leg. The tabletop 50 may typically be raised to waist level or higher for standing.

In particular, the footrest 40 has a crossbar 42 connected at its ends to pivot arms 44. Connected to the inside of the sidewalls 20, the pivot arms 44 can rotate the crossbar 42 between the back position (FIG. 1A in which the crossbar 42 disposes toward the back edge of the tabletop 50) to the front position (FIG. 1B in which the crossbar 42 disposes toward the front edge of the tabletop 50).

As noted above, raising the tabletop 50 from the lowered condition to the raised condition may be coordinated with the rotation of the footrest 40, although this is not strictly necessary. For example, a user may typically want to have the footrest 40 in the front position while the tabletop 50 is raised, but there may be times where this is not the case. In such an instance, the user may be able to override any automatic, coordinated movement of the tabletop 50 and footrest 40 and may instead separately actuate one or the other.

As noted above, movement of the tabletop 50 and footrest 40 can be driven manually or automatically. Any number of mechanical and electrical mechanisms can be used to raise and lower the tabletop 50 and move the footrest 40. Some examples are provided below. As one skilled in the art will appreciate with the benefit of the present disclosure, additional mechanisms can be used depending on the available space in the sidewalls 20, power requirements, and other factors, and the various mechanisms disclosed can be combined in different ways.

Figure 2A:
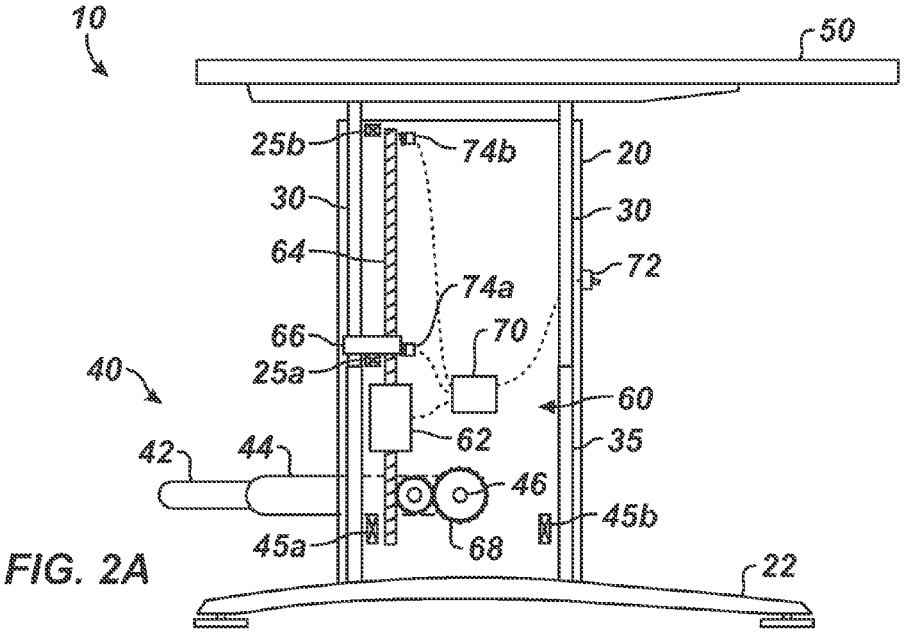
FIGS. 2A-2B show exposed side views of the adjustable desk having an automatic mechanism for adjusting the tabletop and for rotating the footrest.
Figure 2B:
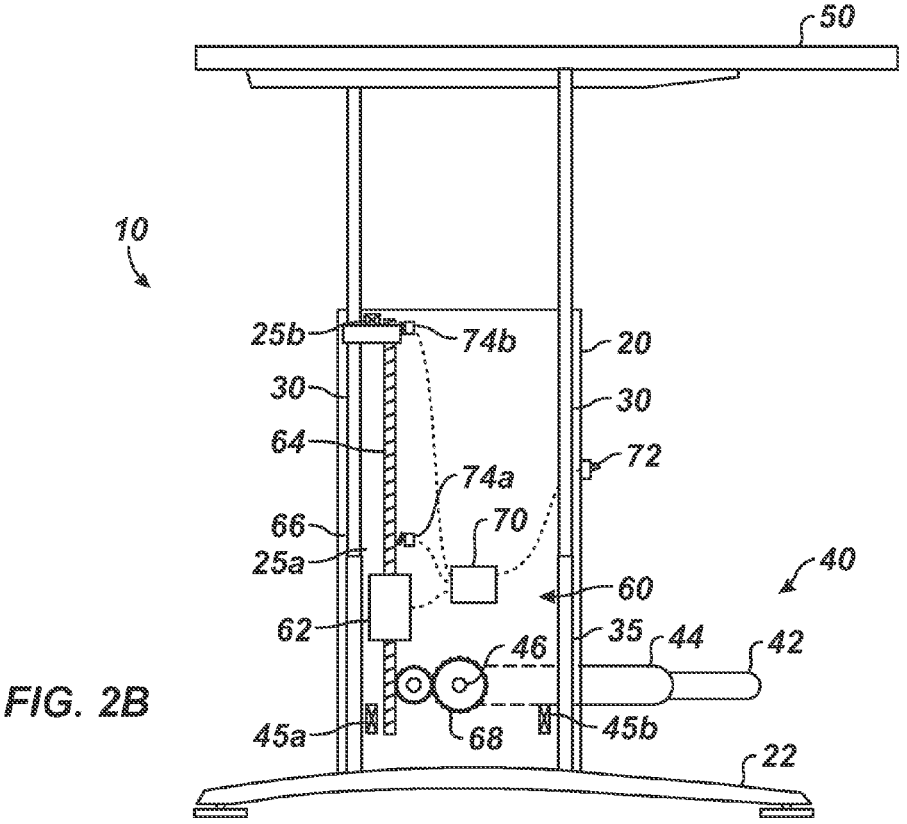

In an automated embodiment, FIGS. 2A-2B show an exposed side view of the adjustable desk 10 having an automated mechanism 60 for adjusting the tabletop 50 and for rotating the footrest 40. The mechanism 60 raises the tabletop 50 to an upright standing height and lowers it to a seated height using an electric motor 62 and any of a number of gear mechanisms. As shown in FIGS. 2A-2B, for example, the electric motor 62 can use a screw shaft 64 to raise and lower the tabletop 50. The shaft 65 has a threaded collar 66 thereon that connects to a telescoping member of one or both of the columns 30. When the motor 62 rotates the shaft 64 in one direction, the collar 66 moves upward along the shaft 64, moving the telescoping member of the column 30. When rotated in the opposite direction, the collar 66 moves downward on the shaft 64 to distend the telescoping column 30.

As shown, a controller 70 activated by a switch 72, button, or the like operates the motor 62. The desk 10 can have its own power supply for the controller 70, motor 62, and other electronic components, or the desk 10 can connect by conventional means to an external power supply. Limit switches 74*a-b* at the lower and upper limits along the shaft 62 can be used by the controller 70 to stop activation of the motor 62 when lowering and raising the tabletop 50. Moreover, hard stops 25*a-b* can limit the lower and upper extents of the movement by engaging against the collar 66. The hard stops 25*a-b* or other portions of the mechanism 60 can have lock mechanisms (not shown) to engage the tabletop's movement, and the lock mechanisms can be configured to provide the user with an audible "click" to indicate full extension or retraction.

In this embodiment, movement of the footrest 40 is coordinated with the movement of the tabletop 50. For instance, a pivot point 46 of the footrest's arm 44 can use one or more rotatable gears 62 interfaced with the screw shaft 64. As the electric motor 62 moves the tabletop 50 by rotating the screw shaft 64, the rotatable gears 68 rotate the footrest 40 about its pivot point 46. As with the movement of the tabletop 50, hard stops 45*a-b* can limit the back and front extents of the footrest's movement by engaging against the lever arms 44 or other portion of the footrest 40. Limit switches (not shown) may also be used.

As noted above, the height of the tabletop 50 can be adjusted by the user to a preferred height within some range, but the user may want to use the footrest 40 for standing regardless of the height of the raised tabletop 50. Therefore, movement of the footrest 40 can be controlled independently from the movement of the tabletop 50 in one implementation. In this case, the footrest 40 may have its own actuator or motor (not shown) independently controlled by the controller 70. This would allow a user to select movement of the tabletop 50 with the switch 72 independent of selecting movement of the footrest 40, which could be controlled with its own switch.

Alternatively, the footrest's movement when coordinated with the tabletop's movement can complete the rotation between the back and front positions separately to some extent. For example, the limit switches 74*a-b* disposed at appropriate locations along the screw drive 62 can activate a separate electric motor (not shown) to rotate the footrest 40 into position. A mechanical arrangement of gears and trigger points could achieve the same result.

Movement of the tabletop 50 and footrest 40 preferably has a shut-off mechanism to prevent their movement if an obstruction is encountered. For example, if the torque on the motor 62 exceeds a predetermined threshold, the rotation of the motor 62 can be stopped or reversed when the controller 70 senses the increased torque. Alternatively, the automated mechanism 60 can use a mechanical torque limiter (not shown) between the coupling of the motor 62 to the screw shaft 64. If the torque exceeds a threshold, the mechanical torque limiter will prevent the motor's rotation from rotating the screw shaft 62 so the tabletop 50 will no longer move.

Moreover, the tabletop 50 and footrest 40 can have break-away mechanisms that release or break their movement if an obstruction is encountered. As will be appreciated, these and other mechanisms can reduce the chances of the movement of the tabletop 50 and footrest 40 damaging the desk 10 or causing injury.

Figure 3A:
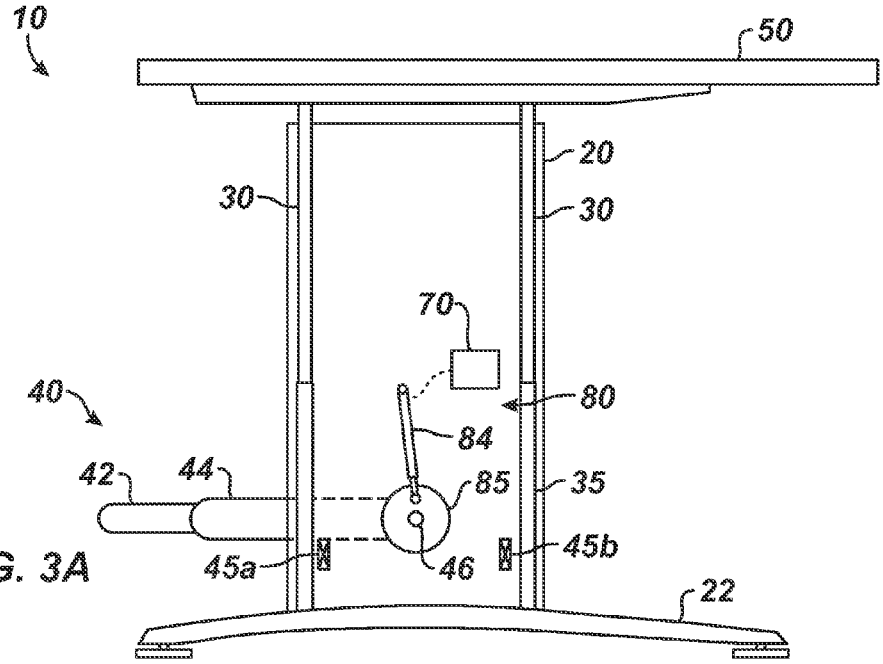
FIGS. 3A-3B show exposed side views of the adjustable desk having a gas spring or strut for raising the tabletop and having an automated mechanism for rotating the footrest.
Figure 3B:
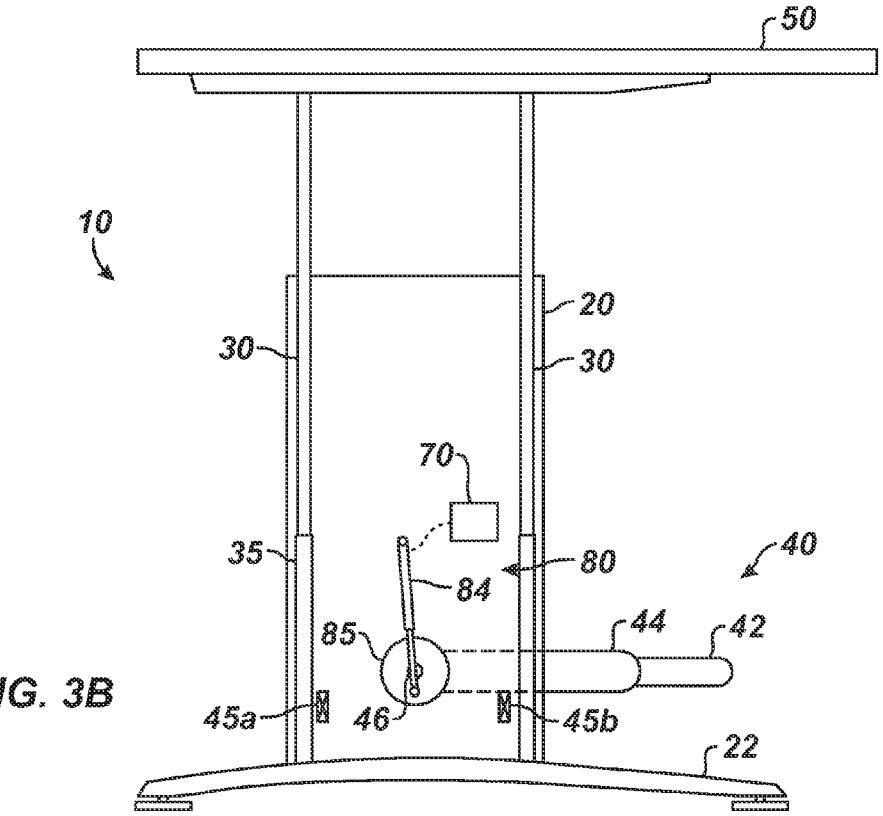

In one manual mechanism, FIGS. 3A-3B show an exposed side view of the adjustable desk 10 having gas springs or struts 35 for raising the tabletop 50 and an actuator 84 for rotating the footrest 40. The gas springs 35 are incorporated into or part of the columns 30 used to support the tabletop 50 to the sidewalls 20, and the gas springs 35 can be similar to those used for other types of furniture, such as chairs.

Raising the tabletop 50 involves the user activating a manual lever or electric actuator (not shown), which diverts the compressed gas in the springs 35. In the absence of sufficient counterforces, the springs 35 will tend to extend, and the columns 30 will lift the tabletop 50 away from the sidewalls 20. To lower the tabletop 50, the user can again activate the lever or actuator (not shown) and can apply a counterforce on the tabletop 50 to distend the gas springs 35, causing the tabletop 50 to move closer to the sidewalls 20.

As for the footrest 40, its movement can be coupled to the raising and lowering of the tabletop 50 by the gas springs 35 using any number of arrangements of belts, gears, drives, etc. Additionally, the footrest 40 can have its own separate actuator, such as a linear actuator. In the example shown in FIGS. 3A-3B, the footrest 40 has an electrical linear actuator 84 coupled to the controller 70. When activated, the linear actuator 84 extends or retracts so that the eccentric pivot point of the actuator 84 to a rotating gear 85 on the footrest's pivot 46 will rotate the footrest 40 to the front or back position. The controller 70 can activate the linear actuator 84 when the user selects a manual switch (e.g., 72: FIGS. 2A-2B), when a limit switch (e.g., 75: FIGS. 2A-2B) at some point along the gas spring 35 is activated, or when some other initiation is performed.

In yet another alternative, the footrest 40 can have its own separate mechanical actuator, such as a gas spring. For example, the actuator 84 in FIGS. 3A-3B may actually be a gas-spring 84. Movement of the gas spring 84 is released when the tabletop 50 hits a certain height where a limit switch (not shown) is disposed, for example, and the expansion of the gas spring 84 can move the footrest 40 from one position to the other. Once expanded, the gas spring 84 can be free to retract once the tabletop 50 returns to a certain height near the seated position. This arrangement, therefore, can use an electrically initiated, but manually assisted deployment of the footrest 40.

Figure 4A:
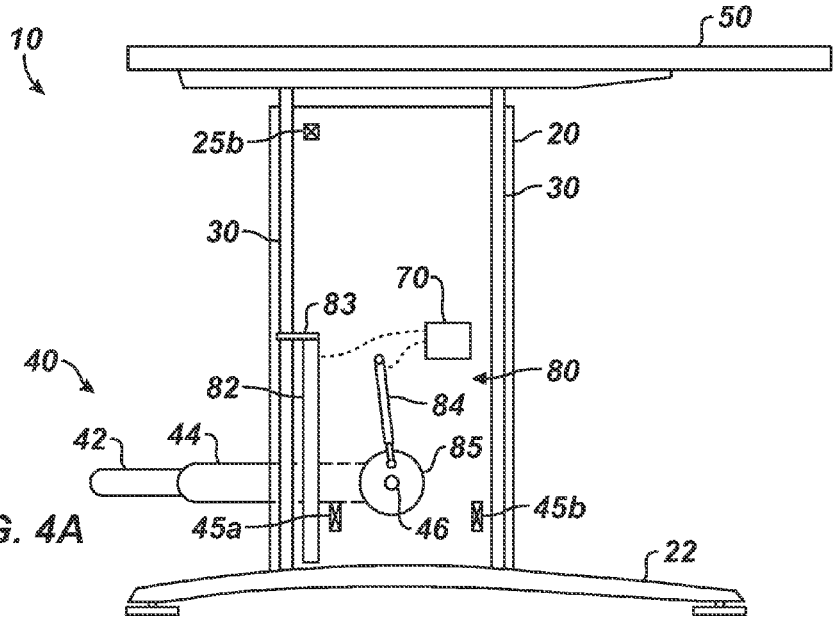
FIGS. 4A-4B show exposed side views of the adjustable desk having linear actuators for adjusting the tabletop and for rotating the footrest.
Figure 4B:
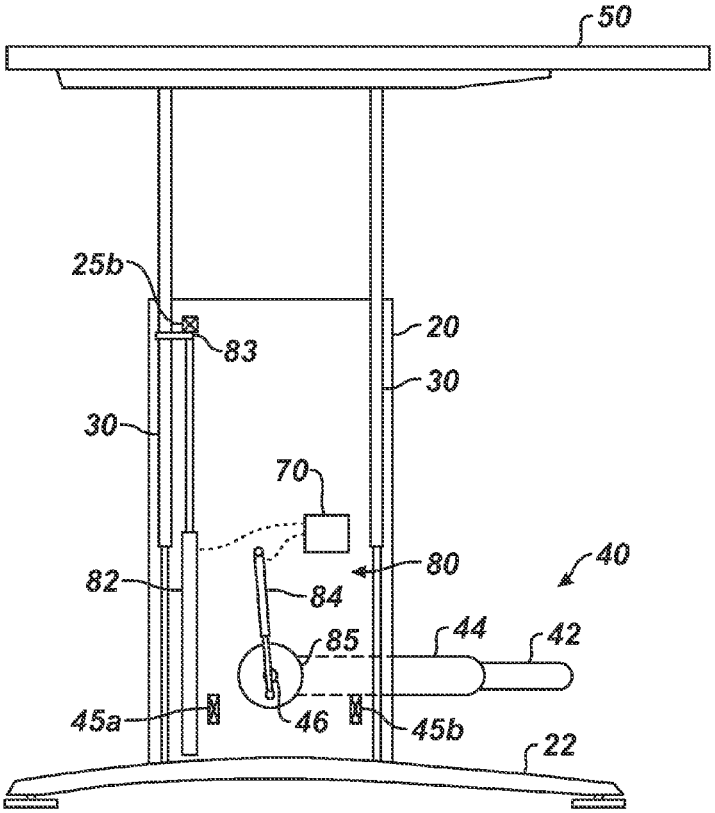

In another automated embodiment, FIGS. 4A-4B show an exposed side view of the adjustable desk 10 having another automated mechanism 80 for raising and lowering the tabletop 50 and for rotating the footrest 40. This mechanism 80 has linear actuators 82 and 84 coupled to a controller 70, and the linear actuators 82 and 84 can be similar to those used in electronic automation.

As shown, the main actuator 82 couples to one of the columns 30, although several of the columns can have such an actuator 82. When controlled by the user, the controller 70 activates the main actuator 82, which extends as shown in FIG. 4B. As a result, the telescoping columns 30 likewise extend and raise the tabletop 50. The main actuator 82 may raise the tabletop 50 to its pinnacle position, at which point a lock or catch mechanism (not shown) may engage the telescoping columns 30 preventing inadvertent lowering of the tabletop 50. In one alternative, the telescoping column 30 may include a ratcheting mechanism (not shown) that catches the extension of the column 30 at multiple points along its extension. Otherwise, the linear actuator 82 may remain supplied with power to maintain the tabletop 50 raised. Either way, lowering the tabletop 50 would require the user to deactivate any lock, catch, or ratchet mechanism, which can be achieved manually or automatically.

In the arrangement of FIGS. 4A-4B, the footrest 40 is separately actuated by a linear actuator 84, although a rotatable motor could be just as easily used. As with the previous embodiment, the linear actuator 84 has one fixed end connected to the side support 20 or elsewhere, and the actuator 84 has another rotatable end eccentrically connected to a wheel or pivot gear 85 of the footrest's pivot 46. When the linear actuator 84 is extended, its eccentrically connected end causes the gear 85 to rotate, which in turn rotates the footrest 40 to switch between the back and front positions. Reverse rotation and switching occurs when the linear actuator 84 is distended. If a rotatable motor is used, simply rotating in one or another direction can achieve the same result.

Figure 5A:
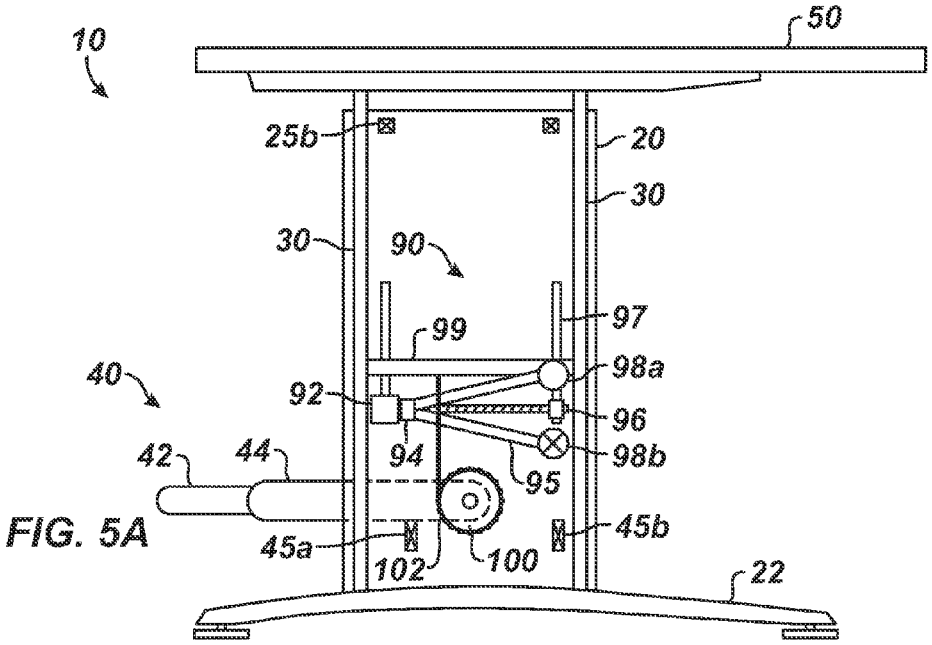
FIGS. 5A-5B show exposed side views of the adjustable desk having another automated mechanism for adjusting the tabletop and for rotating the footrest.
Figure 5B:
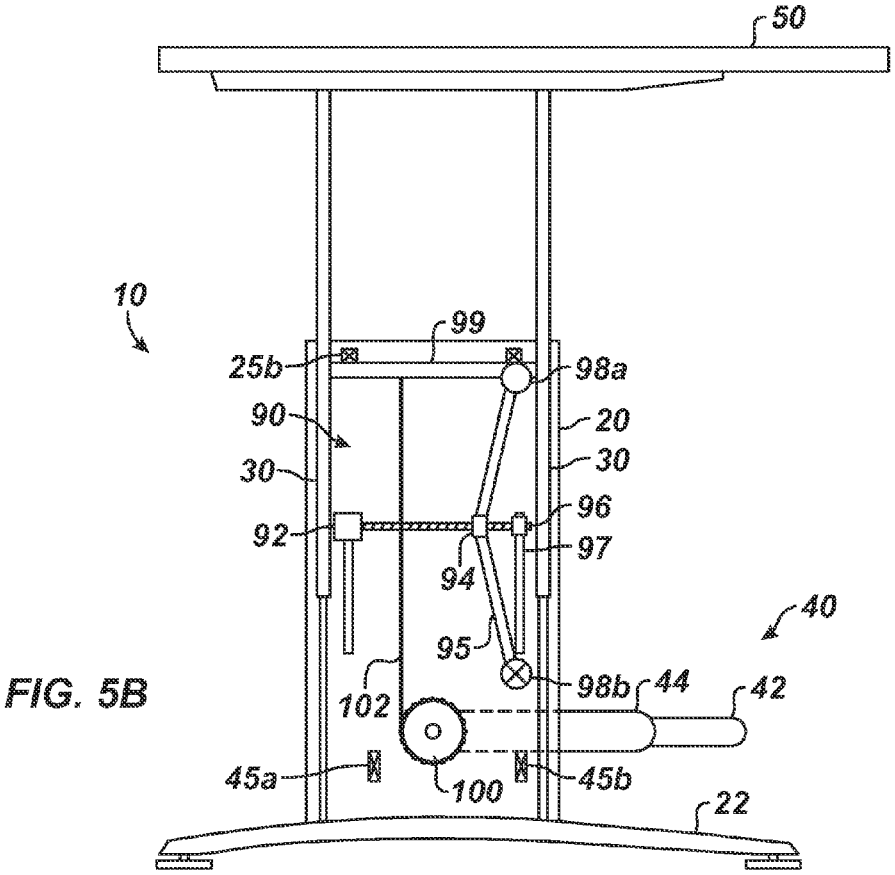

In yet another embodiment, FIGS. 5A-5B show an exposed side view of the adjustable desk 10 having another automated mechanism 90 for raising and lowering the tabletop 40 and for rotating the footrest 40. This mechanism 90 has a motor 92 that rotates a scroll rod 96 and causes a collar 94 threaded on the rod 96 to move along the scroll rod 96 depending on the rotation of the rod 96.

As the collar 94 moves, a scissor linkage 95 pivotably connected to the collar 94 opens or closes to raise and lower the tabletop 50. For instance, one arm of the linkage 95 connects at its distal end to a fixed pivot point 98*b* attached to the side support 20, while the other scissor arm of the linkage 95 connects at its distal end to a moving pivot point 98*a* attached on a cross member 99 between the adjacent columns 30. The motor 92 and rod 96 move with the opening and closing of the linkage 95 so tracks 97 may be provided for the motor 92 and rod 96 to move up and down.

To raise the tabletop 50 from the lowered condition in FIG. 5A, the user operates a controller (not shown), such as discussed above, which actuates the motor 92 and rotates the rod 96. The collar 94 on the rod 96 moves away from the motor 92, causing the linkage 95 to begin to spread open. Because one point 98*b* is fixed, the opening linkage 95 lifts the columns 30 with the cross member 99 and raises the tabletop 50. Lowering the tabletop 50 simply requires a reverse operation in which the motor 92 rotates the scroll rod 96 in an opposite direction to close the linkage 95.

As noted previously, the footrest 40 can have a separate actuator to switch the footrest's position, and the separate actuator may or may not be coordinated to the automated mechanism 90 for the tabletop 50. For example, a motor, linear actuator, gas spring, or the like can be used, as discussed elsewhere.

As shown in FIGS. 5A-5B, however, movement provided by the automated mechanism 90 can switch the footrest 40 as well. Here, the footrest's pivot 46 has a pivot wheel 100 with an internal spring that biases the footrest 40 to pivot toward the back position in FIG. 5A. A line 102, chain, belt, or the like is connected and wrapped counterclockwise around the wheel 100 and extends up to the cross member 99 of the mechanism 90.

When the tabletop 50 is lowered (FIG. 5A), the bias of the wheel 100 retracts the line 102 to its shortest length and rotates the footrest 40 to its back position. As the tabletop 50 is raised as in FIG. 5B, the cross member 99 pulls the line 102 and rotates the wheel 100 against its bias so that the footrest 40 rotates to the front position. This and any other suitable mechanism of gears, belts, and the like can be used to coordinate the movement of the automated mechanism 90 and the footrest 40.

Figure 6A:
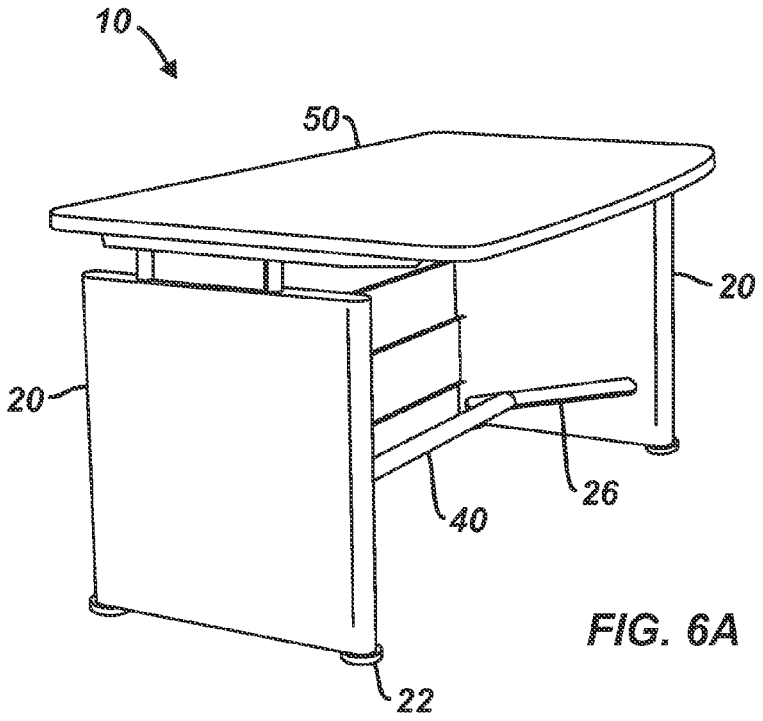
FIGS. 6A-6B show perspective views of another adjustable desk having a tabletop in a lower condition and in a raised condition and having a footrest in a back position and in a front position.
Figure 6B:
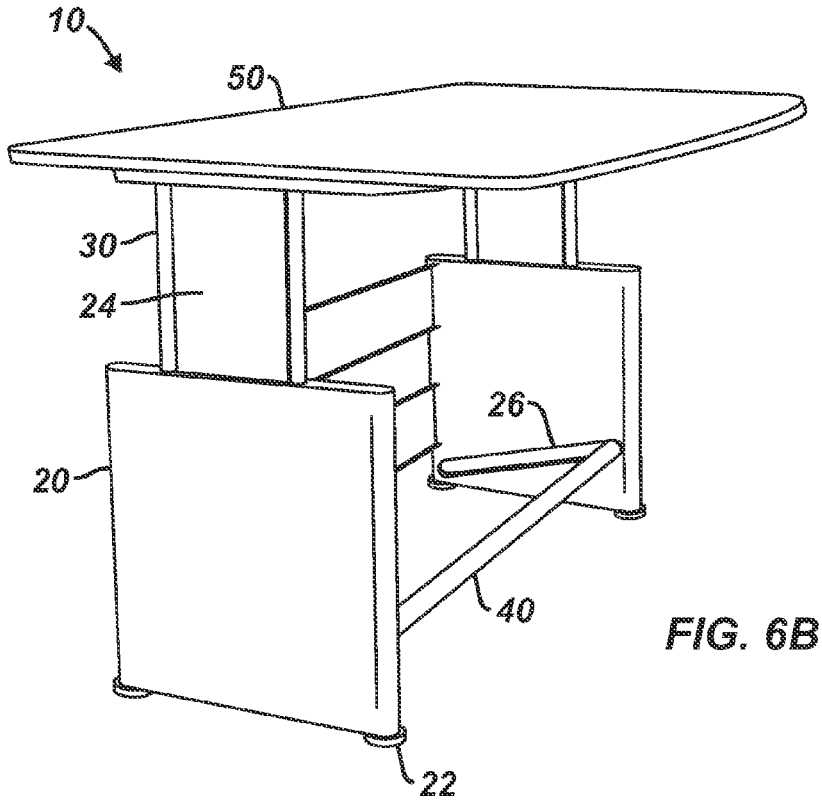

Turning to another embodiment, an alternative footrest 40 can slide between back and front positions rather than rotating or pivoting as in previous embodiments. FIGS. 6A-6B show perspective views of an adjustable desk 10 having a sliding footrest 40 that slides in slots 26 in the sidewalls 20. The desk 10 is shown with the tabletop 50 in the lower condition (FIG. 6A) and in the raised condition (FIG. 6B). Likewise, the footrest 40 is shown in a retracted condition (FIG. 6A) and an extended condition (FIG. 6B).

Figure 7A:
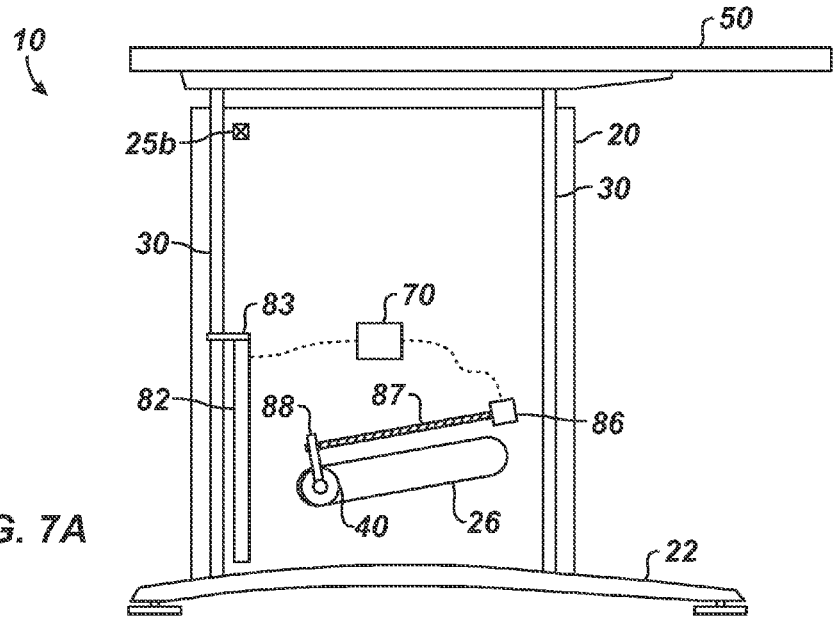
FIGS. 7A-7B show exposed side views of the adjustable desk of FIGS. 6A-6B having automated mechanisms for adjusting the tabletop and for moving a sliding footrest.
Figure 7B:
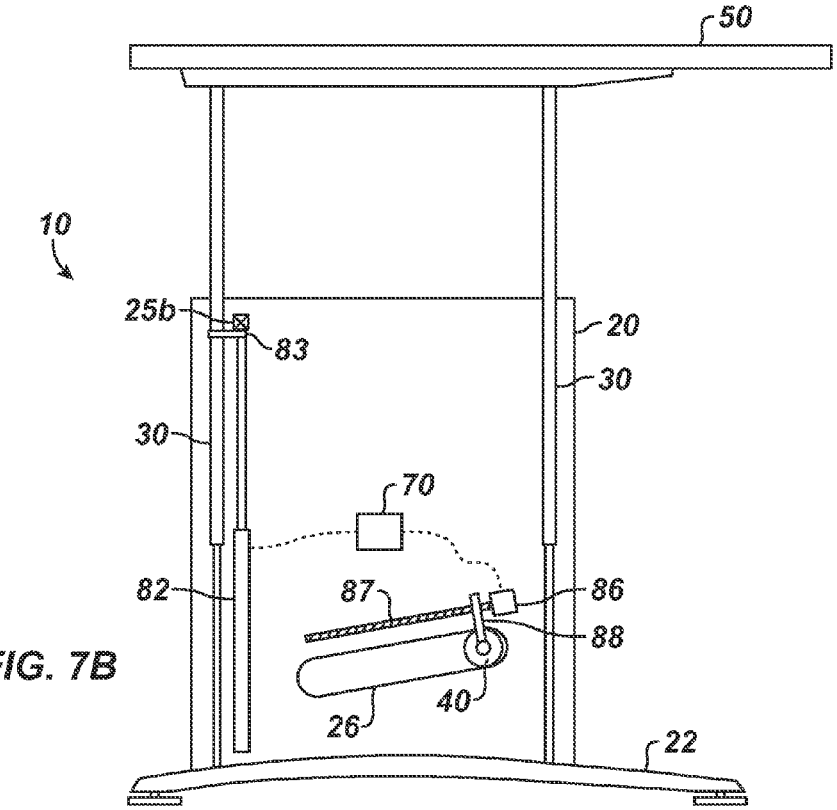

Again, any number of the mechanisms disclosed herein can be used to manually or automatically move the tabletop 50 and footrest 40 either together or independently. For example, FIGS. 7A-7B show an exposed side view of the adjustable desk 10 having the footrest 40 that slides in the slots 26 in the sidewalls 20. As shown in the particular example of FIGS. 7A-7B, a linear actuator 83 is used for moving the tabletop 50 as described previously. Additionally, a motor 86, scroll rod 87, and collar 88 are used for sliding the footrest 40.

Raising and lowering of the tabletop 50 with the linear actuator 82 and controller 70 can be similar to that described above. The footrest 40, however, fits its end inside the slanted channel 26 in the side support 20. The motor 86 rotates the scroll rod 87, causing the threaded collar 88 connected to the footrest 40 to move along the rod 87 up or down depending on the motor's rotation. As the tabletop 50 is raised, for example, the motor 86 can rotate the scroll rod 87 so that the footrest 40 moves from the back position (FIG. 7A) to the front position (FIG. 7B).

Figure 8:
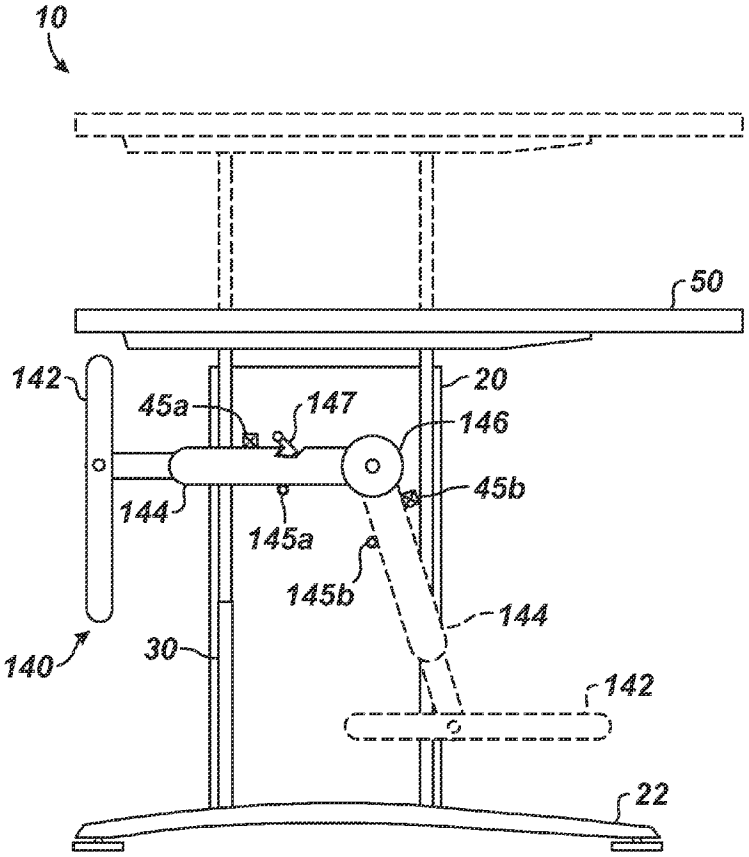
FIG. 8 shows an exposed side view of the adjustable desk having an alternative rotating footrest.

Turning to another embodiment of a footrest, the pivot point of a footrest can be set higher relative to the tabletop 50, and the footrest can be pivoted 90-degrees rather than 180-degrees between positions. As shown in FIG. 8, for example, an exposed, inside view of one of the sidewalls 20 shows components of another rotating footrest 140. An arm 144 connects to a pivot 146 set higher inside the sidewall 20, and a cross member 142 connects onto the end of the arm 144. As shown, the cross member 142 can be a platform, although it could be a bar or other shaped feature.

Not all of the mechanisms of the desk 10 are shown. For instance, although not visible in the view of FIG. 8, the other sidewall of the desk 10 would have a comparable arm 144 connected to a pivot 146, and the platform 142 would extend between both arms 144 to form the rest underneath the tabletop 50. The platform 142 may also be able to pivot to a limited extent on the arms 144.

The footrest 140 rotates about 90-degrees between a retracted (seated) position near the back of the tabletop 50 (as shown in solid line) to a rotated (standing) position towards the front of the tabletop 50 (as shown in dashed line). In the retracted position (solid lines), for example, the platform 142 of the footrest 140 can form a privacy screen. When a user is seated at the desk 10 with the tabletop 50 lowered, the platform 142 provides the seated user with privacy by covering the exposed front of the desk 10. When the tabletop 50 is raised, the footrest 140 can deploy from the retracted (seated) position to the rotated (standing) position (in dashed lines) so the user can use the platform 142 while standing.

Deployment of the footrest 140 can use any of the various mechanism disclosed herein and can be automatically coordinated with the movement of the tabletop 50 as with other embodiments. For example, the footrest 140 may begin deploying when the tabletop 50 reaches about 34" in height, and the footrest 140 can be fully deployed when the tabletop 50 is at about 38" in height. Moreover, as noted above, deployment of the footrest 140 can be automatic but not coordinated with the movement of the tabletop 50 so the user can adjust the footrest 140 to retracted, fully lowered positions, or any point therebetween as desired regardless of the height of the tabletop 50.

As with previous embodiments, hard stops 45*a-b* can be used to limit the movement of the footrest 140 by limiting the rotation of the arms 144, although other stops can be used. Additionally, various types of locks may be used to keep the footrest 140 in position. For example, a mechanical catch 147 can engage the footrest 140 by engaging in a profile in the arm 144 for example to hold the footrest 140 in the retracted position. Another comparable catch disposed elsewhere on the sidewall 20 can be used to catch the arm 144 when in the rotated position. The catch 147 can be spring biased to engage the arm's profile and may be mechanically or electrically deactivated.

In another example, actuatable locks 145*a-b*, such as solenoids, linear actuators, or the like can engage opposite edges of the arm 144 when in the retracted and rotated positions respectively. These actuatable locks 145*a-b* can thereby hold the arm 144 and footrest 140 in place and can be actuated to release the arm 144 when the footrest 140 is to be pivoted.

Figure 9C:
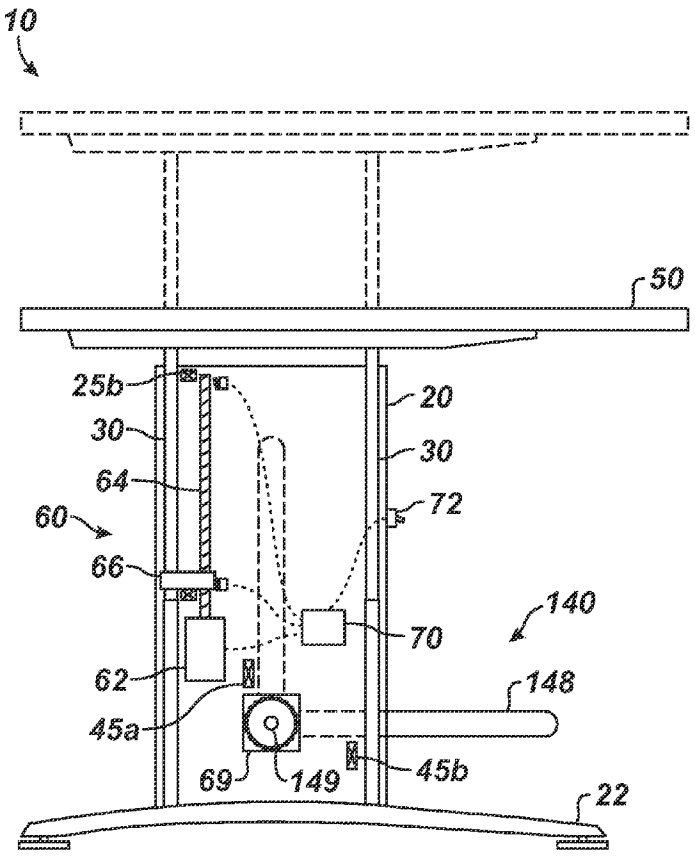
FIG. 9C shows an exposed side view of the adjustable desk of FIGS. 9A-9B having an automatic mechanism for adjusting the tabletop and for rotating the footrest.
Figure 9A:
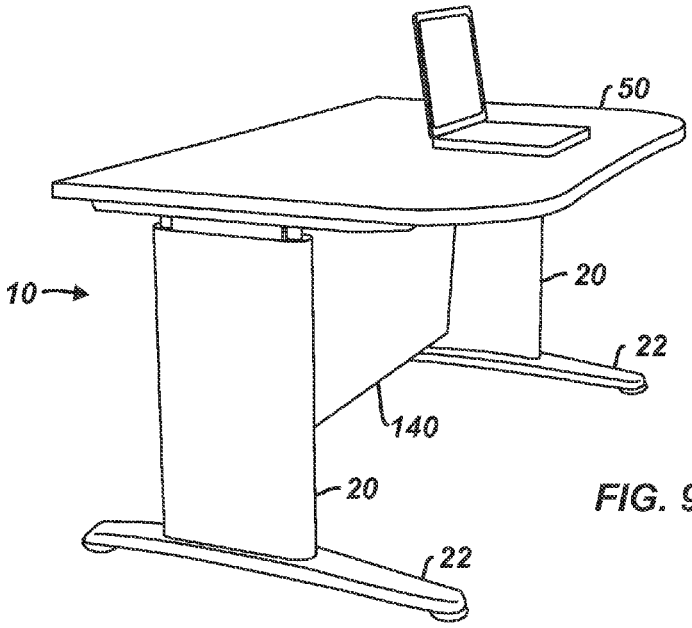
FIGS. 9A-9B show perspective views of another adjustable desk having a tabletop in a lower condition and in a raised condition and having a footrest in a back position and in a front position.
Figure 9B:
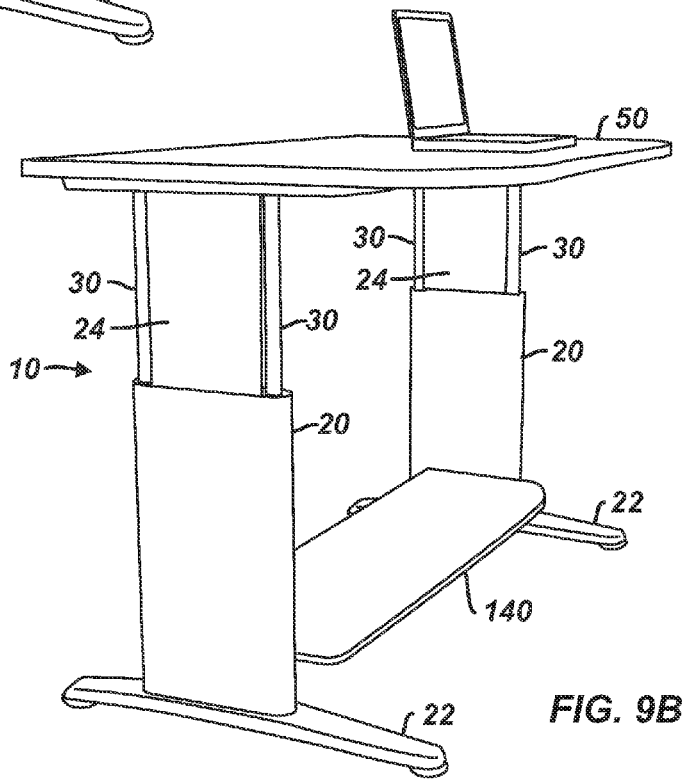

Yet another embodiment of an adjustable desk 10 shown in FIGS. 9A-9B has a footrest 140 that pivots and a tabletop 50 that raises and lowers. The footrest 140 pivots between a retracted condition (FIG. 9A) and an extended condition (FIG. 9B), and the tabletop 50 moves between a lower condition (FIG. 9A) and a raised condition (FIG. 9B). Again, the tabletop 50 and footrest 140 can be operated separately or together, and the footrest 140 preferably rotates to its position for standing when the tabletop 50 is at a height set for standing.

The footrest 140 in this embodiment is a flat panel 148 that rotates at one edge connected to the sidewalls 20. In the raised condition for sitting, the panel footrest 148 is rotated vertically so that it forms a privacy screen for a user sitting at the desk 10. When the tabletop 50 is raised to a height for standing, the panel footrest 148 rotates down to a lowered condition so that it lies horizontally under the tabletop 50 near the floor.

Again, any number of the mechanisms disclosed herein can be used to manually or automatically move the tabletop 50 and footrest 140 either together or independently. For example, FIG. 9C show an exposed side view of the adjustable desk 10 having an automatic mechanism 60 for adjusting the tabletop 50 and for rotating the footrest 140. The mechanism 60 has a motor 62, a scroll rod 64, and a collar 66 for raising and lowering the tabletop 50. The mechanism 60 also uses a motor 69 for rotating the footrest 140 about a pivot 149, and a controller 70 operates the motors 62 and 69. Of course, consistent with the present disclosure, any number of the mechanisms disclosed herein can be used.

Figure 10A:
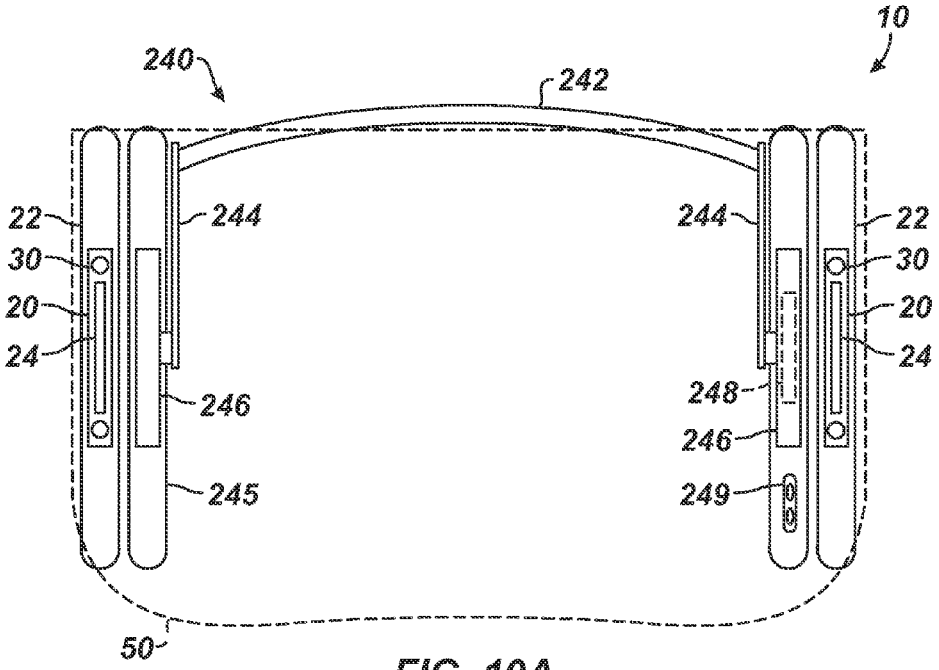
FIGS. 10A-10B show plan and bottom views of another embodiment of an automatic footrest for use alone or with a desk.
Figure 10B:
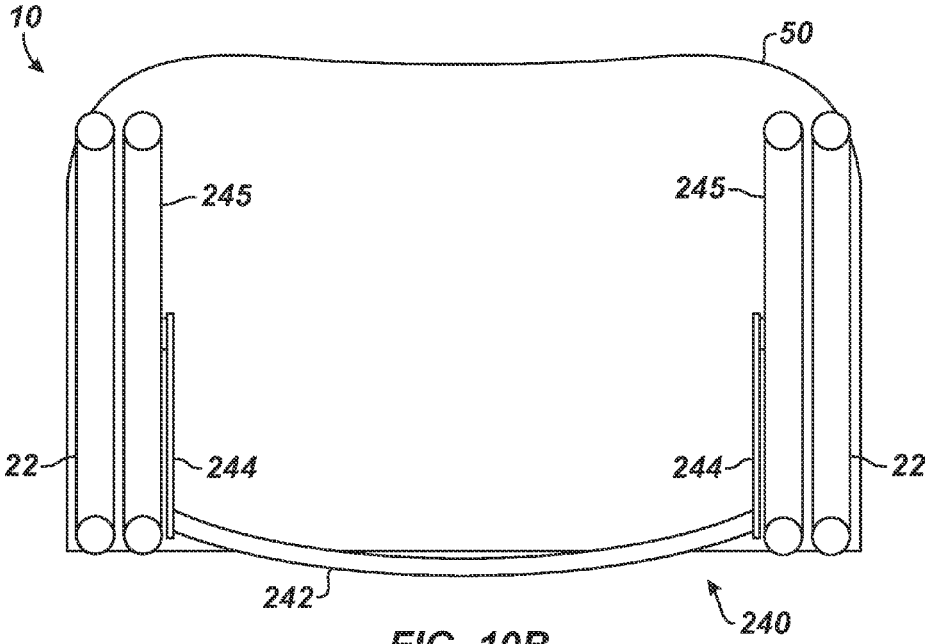
Figure 10C:
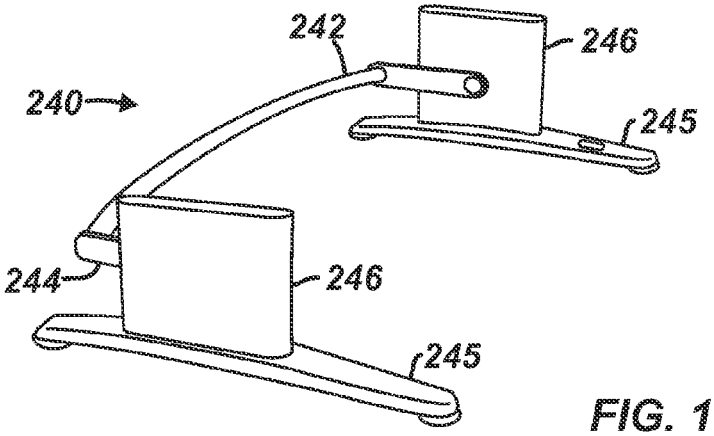
FIG. 10C shows a perspective view of the automatic footrest alone.

In previous embodiments, the adjustable footrests have been incorporated into the desks. In another embodiment, FIGS. 10A-10B show plan and bottom views of an automatic footrest 240 for use alone or with a desk 10, which may or may not have a height-adjustable tabletop 50. FIG. 100 shows a perspective view of the footrest 240 by itself.

The footrest 240 has a set of feet 245 arranged parallel to one another. Each foot 245 has a stand 246 extending from the top of the foot 245. An interconnecting rest 242 affixes to lever arms 244 on the stands 246 and extends between the feet 245. One or both of these stands 246 holds components of an automatic mechanism 248 (e.g., self-contained motor, springs, gas pistons, etc.) for moving the levers 244 and the interconnecting rest 242.

Although lever arms 244 and rest 242 that pivot are shown, the footrest 240 could have a rotating panel, sliding cross bar, or any of the other arrangements disclosed herein. Additionally, although two feet 245 and stands 246 are shown, the footrest 240 may use one foot 245 and stand 246 having the rest 242 extending in a cantilever fashion from the lever 244 on the stand 246. Such an arrangement can be used as long as the foot 245 can support the rest 242 with a person's foot resting thereon and can resist tilting, turning, or the like.

The length of the rest 242 can be adjustable so that the separation between the two feet 245 and stands 246 can be adjusted to accommodate the desk 10, table, counter, or other area under which the footrest 240 is used. Additionally, the stands 246 need not have an extended height so the footrest 240 can position underneath a desk, table, counter, or other area. Although not visible in the plan views shown, the stands 246 may be shorter than or at least as tall as the supports 20 of the desk 10 under which the footrest 240 can be used. Either way, the stands 246 enable the footrest 240 to fit underneath the tabletop 50 of the desk 10.

As noted above, the tabletop 50 of the existing desk 10 may or may not be height-adjustable, and the footrest 240 fits underneath the tabletop 50 as disclosed herein. In the present example, the tabletop 50 is height-adjustable, either automatically or not. Regardless, the footrest 240 having its own internal mechanism 248 can be activated independently of (or in conjunction with) the desk's tabletop 50. For example, a user can manually press a button, switch, or control 249 to actuate the footrest 240 when either automatically or manually raising the tabletop 50 of the desk 10. This control 249 can be disposed on one of the feet 245 for the user to engage with her foot to extend and retract the rest 242.

Alternatively, the footrest 240, even though a separate device from the desk 10, can be activated automatically in response to the raising and lowering of the desk's tabletop 50. An interconnecting cable or other connection (not shown) can connect between the footrest's mechanism 248 and the desk's mechanism (not shown) and can be used to activate the footrest 240 when the tabletop 50 raises and lowers on the desk 10. Such a connection can convey an electronic signal from the desk's mechanism (not shown) to the footrest's mechanism 248 or visa-versa to coordinate operation between the two. In other alternatives, the footrest's mechanism 248 may have a motion sensor, a proximity sensor, or the like to detect the tabletop 50 moving from seated to standing positions (or visa-versa) so the footrest 140 can auto-deploy in like manner with the movement of the tabletop 50. These and other techniques for automated operation can be used.

Figure 11:
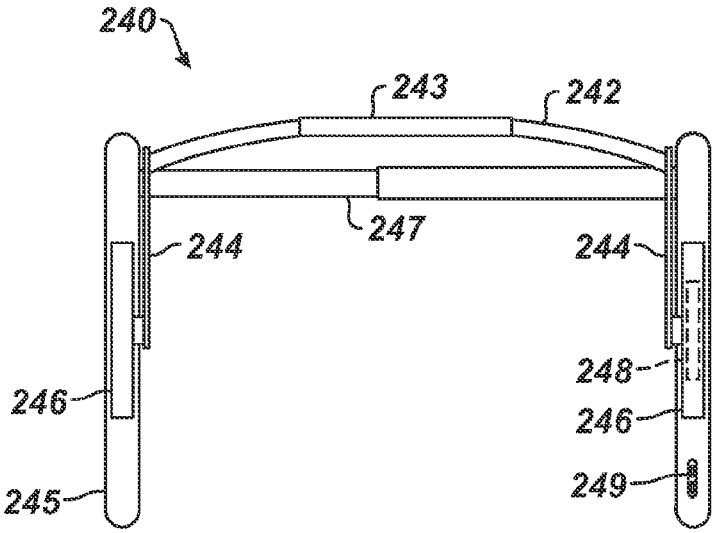
FIG. 11 shows a plan view of another automatic footrest.

FIG. 11 shows a plan view of yet another automatic footrest 240. Here, the footrest 240 is shown alone without a desk, tabletop, counter, or other work surface, although the footrest 240 could and likely would be used with one. The feet 245 are interconnected on this footrest 240 with an interconnecting bar 247 that holds the feet 245 at a particular distance and can help stabilize the footrest 240. The bar 247 can be flat and can lie close to the floor to maintain a low profile.

The lengths of the bar 247 and the rest 242 can be adjustable so that the separation between the two feet 245 and stands 246 can be adjusted to accommodate the table or area under which the footrest 240 is used. For example, an intermediate piece or bar 243 can affix as part of the rest 242 between the levers 244 to adjust the length of the rest 242. The bar 247 between the feet 245 may telescope to change the length of the bar 247 and adjust the separation between the feet 245. These and other forms of adjustment can be used.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In the examples above, only one side support 20 has been shown with a manual or automated mechanism for moving the tabletop and/or switching the footrest. It will be appreciated that the other side support 20 of the adjustable desk 10 may or may not have the same mechanism or a different mechanism, depending on the balance required, the forces of friction and weight involved, etc. Moreover, although two side supports 20 are shown, the desks 10 may use one side support 20 having the rest 40 or 140 and the tabletop 50 extending in a cantilever fashion from the support 20. Such an arrangement can be used as long as the support 20 can support the rest 40 or 140 and tabletop 50 with weight resting thereon and can resist tilting, turning, or the like. For example, feet for such a single side support 20 may extend laterally under the tabletop 50 to support the desk 10.

Various mechanisms have been described for raising and lower the tabletop 50 and/or for switching the footrests 40, 140, and 240. Each of the described mechanisms can be used in any of the disclosed desks 10 and footrests 40, 140, and 240, including those desks 10 having the footrest 140 that acts as a privacy screen and flips down about 90-degrees to form the rest for the user, the footrest 40 that rotates 180 degrees, the footrest 40 that slides, and the footrest 240 that can be used separate from a desk. In general, the mechanisms can use cables, rotating gears, screw gears, rack and pinion gears, motors, actuators, cranks, levers, hydraulic pistons, gas-lifts, gas struts, springs, counter balances, and the like for manually and automatically raising and lowering the tabletop 50 and/or for switching the footrests 40, 140, and 240. Moreover, any combination of such mechanisms can be used with one another in a given embodiment.

Pickup gear stops and pre-set electric actuators, switches, and the like can allow for the required movement to occur between hard stops during transitions of the tabletop 50 and footrest 40, 140, or 240. The automatic, direct drive arrangements preferably have a break-away or fail-safe stop and/or a panic button. Manual systems can have a free rotational shaft, a dampened rotational or torsional shaft, or spring-loaded hinge.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A desk, comprising:

a tabletop;

at least one base member supporting the tabletop;

a footrest movably disposed on the at least one base member beneath the tabletop, the footrest having a back position toward a back of the desk and having a front position toward a front of the desk;

a first gas spring disposed on the at least one base member and operatively coupled to a rotating gear on the footrest;

a second gas spring disposed on the at least one base member, the second gas spring operatively coupled to the tabletop and operatively linked to the first gas spring; and a controller operatively coupled to the first and second gas springs such that movement of the footrest is automatically coordinated with movement of the tabletop to automatically position the footrest in the front position when the tabletop is moved from lowered positions past a user standing height toward raised positions, and to automatically position the footrest in the back position when the tabletop is moved from the raised positions past a user sitting height toward the lowered positions, wherein the tabletop toward the raised positions above the user standing height corresponds to the footrest positioned in the front position and the tabletop toward the lowered positions below the user sitting height corresponds to the footrest positioned in the back position.

2. The desk of claim 1, wherein the at least one base member comprises a support supporting the tabletop above the at least one base member and movable vertically relative to the at least one base member.

3. The desk of claim 2, wherein the first gas spring is operatively coupled to the support and moves the support vertically to raise and lower the tabletop between the raised and lowered positions.

4. The desk of claim 1, wherein the at least one base member comprises adjacent base members supporting the tabletop, wherein the footrest is disposed between the adjacent base members beneath the tabletop.

5. The desk of claim 1, wherein in the concurrent movement between the footrest and the tabletop, the footrest positions in the front position in direct response to the tabletop moves past the user standing height and separate from the tabletop completing the movement to one of the raised positions past the user standing height.

6. The desk of claim 1, wherein the user standing height is different from the user sitting height.

7. The desk of claim 1, further comprising at least one limit switch responsive to the movement of the tabletop and associated with at least one of the user sitting height and the user standing height.

8. A desk, comprising:

at least one base member having at least one support movable vertically relative to the at least one base member;

a tabletop supported on the at least one support above the at least one base member;

a footrest movably disposed on the at least one base member beneath the tabletop, the footrest having a back position toward a back of the desk and having a front position toward a front of the desk; and a second gas spring disposed on the at least one base member and operatively coupled to the at least one support;

a first gas spring disposed on the at least one base member and operatively coupled to a rotating gear on the footrest; and a controller operatively coupled to the first and second gas springs such that movement of the footrest is automatically coordinated with movement of the tabletop to position, the controller moving the at least one support vertically relative to the at least one base member to raise and lower the tabletop relative to the at least one base member past user standing and sitting heights and concurrently positioning the footrest in the back and front positions, wherein the controller and the first and second gas springs automatically coordinate the movement of the at least one support for the tabletop between lowered and raised positions past the user standing and sitting heights to the movement of the footrest between the back and front positions, wherein the footrest is automatically positioned in the front position when the tabletop is moved from the lowered positions past the user standing height toward the raised positions, and wherein the footrest is automatically positioned in the back position when the tabletop is moved from the raised positions past the user sitting height toward the lowered positions.

9. The desk of claim 8, wherein the at least one base member comprises adjacent base members disposed underneath the tabletop, wherein the footrest is disposed between the adjacent base members.

10. The desk of claim 8, wherein the first gas spring comprises an arm pivotably connected to the at least one base member; wherein the footrest comprises a rest connected to the arm; and wherein the rest pivots with the arm to position in the back and front positions.

11. The desk of claim 10, wherein the rest comprises a cross member having an end connected to the arm.

12. The desk of claim 8, wherein the footrest comprises a rest connected in a channel in the at least one base member, wherein the rest slides in the channel to position in the back and front positions.

13. The desk of claim 12, wherein the rest comprises a cross member having an end disposed in the channel.

14. The desk of claim 8, wherein the footrest comprises a platform pivotably connected to the at least one base member, the platform pivotable to the back position in which the platform extends vertically under the tabletop and pivotable to the front position in which the platform extends horizontally under the tabletop.

15. The desk of claim 8, wherein the second gas spring comprises a gas spring incorporated into, part of, or coupled to the at least one support.

16. The desk of claim 8, wherein in the coordinated movement between the at least one support and the footrest, the footrest positions in the back position in direct response to the tabletop moves past the user sitting height and separate from the tabletop completing the movement to one of the lowered positions past the user sitting height.

17. The desk of claim 8, further comprising at least one limit switch responsive to the movement of the tabletop and associated with at least one of the user sitting height and the user standing height.

18. An adjustable footrest for use below a work surface, comprising:

at least one base member disposed below the work surface;

a rest movably disposed on the at least one base member, the rest having a back position toward a back of the work surface and having a front position toward a front of the work surface;

a gas spring disposed on the at least one base member and operatively coupled to a rotating gear on the rest; and a controller operatively coupled to the gas spring and positioning the rest in the back and front positions, wherein the controller automatically coordinates the position of the rest in the back and front positions with movement of the work surface between lowered and raised positions relative to the at least one base member past user standing and sitting heights, wherein the rest being automatically positioned in the front position corresponds to the work surface being moved from the lowered positions past the user standing height toward the raised positions, and wherein the rest being automatically positioned in the back position corresponds to the work surface being moved from the raised positions past the user sitting height toward the lowered positions.

19. The footrest of claim 18, wherein the at least one base member comprises adjacent base members disposed beneath the work surface, wherein the rest is disposed between the adjacent base members.

20. The footrest of claim 18, wherein the rest comprises:

an arm pivotably connected to the at least one base member;

a cross member connected to the arm; and wherein the cross member pivots with the arm to position the rest in the back and front positions.

21. The footrest of claim 20, wherein the cross member comprises a bar having an end connected to the arm.

22. The footrest of claim 18, wherein the rest comprises:

a cross member connected in a channel in the at least one base member, wherein the cross member slides in the channel to position the rest in the back and front positions.

23. The footrest of claim 22, wherein the cross member comprises a bar having an end disposed in the channel.

24. The footrest of claim 18, wherein the rest comprises a platform pivotably connected to the at least one base member, the platform pivotable to the back position in which the platform extends vertically under the work surface and pivotable to the front position in which the platform extends horizontally under the work surface.

25. The footrest of claim 18, wherein the controller comprises a gas spring incorporated into, part of, or coupled to the rest.

26. The footrest of claim 18, wherein the controller comprises an electric actuator operatively coupled to the rest and operable to move the rest.

27. The footrest of claim 26, wherein the electric actuator comprises a rotatable motor or a linear actuator.

28. The footrest of claim 18, wherein the gas spring is operatively linked to the movement of the work surface via a controller; and wherein the controller and the gas spring concurrently coordinate the position of the footrest with the movement of the work surface via the controller.

29. The footrest of claim 18, further comprising at least one limit switch responsive to the movement of the tabletop and associated with at least one of the user sitting height and the user standing height.

* * * * *